US005440963A

United States Patent [19]

Szecsei

[11] Patent Number: 5,440,963

[45] Date of Patent: Aug. 15, 1995

[54] DOUBLE BARREL BOLT ACTION REPEATING RIFLE

[76] Inventor: Jozsef Szecsei, 2555 8th Concession, R.R. #3, Windsor, Ontario, Canada, N9A 6Z6

[21] Appl. No.: 779,760

[22] Filed: Oct. 21, 1991

[51] Int. Cl.[6] ..... F41F 1/08

[52] U.S. Cl. ..... 89/1.41; 89/20.2; 42/16

[58] Field of Search ..... 89/1.41, 19, 20.2, 21, 89/33.1, 11; 42/19, 16

[56] References Cited

U.S. PATENT DOCUMENTS

| | | | |
|---|---|---|---|
| 522,605 | 7/1894 | Lee . | |
| 551,143 | 12/1895 | Nolcken | 42/19 |
| 576,744 | 2/1897 | Seymour . | |
| 792,316 | 6/1905 | Cook . | |
| 1,286,884 | 12/1918 | Revelli | 89/33.1 |
| 1,290,850 | 1/1919 | Sturgeon | 89/33.1 |
| 1,395,460 | 11/1921 | Thompson . | |
| 2,338,682 | 1/1944 | Bohan | 89/21 |
| 2,926,568 | 3/1960 | Neder | 89/33.1 |
| 3,203,129 | 8/1965 | Elkas . | |
| 3,253,362 | 5/1966 | Gitchell . | |
| 3,257,749 | 6/1966 | Donaldson . | |
| 3,270,456 | 9/1966 | Benson . | |
| 3,341,963 | 9/1967 | Seiderman . | |
| 3,426,465 | 2/1969 | Robinson . | |
| 3,494,216 | 2/1970 | Haskins . | |
| 3,631,620 | 1/1972 | Ohira . | |
| 3,653,140 | 4/1972 | Alday | 42/16 |
| 3,720,133 | 3/1973 | Jampy et al. | 89/1.41 |
| 4,669,211 | 6/1987 | Russell . | |

FOREIGN PATENT DOCUMENTS

| | | | |
|---|---|---|---|
| 95582 | 3/1971 | France . | |
| 3724936 | 6/1988 | Germany . | |
| 117918 | 8/1918 | United Kingdom | 89/21 |

*Primary Examiner*—Stephen M. Johnson
*Attorney, Agent, or Firm*—Morgan & Finnegan

[57] ABSTRACT

A bolt assembly is provided for a double-barrel firearm, such as a rifle or a shotgun. The bolt assembly is adapted to fit in the receiver of the double-barrel firearm. The bolt assembly comprises a bolt body which connects to first and second breech bolts, and which also couples to a bolt collar. The bolt collar has a bolt handle for operating the bolt assembly. The bolt body and breech bolts have recesses for accepting first and second firing pin assemblies. The firing pin assemblies include first and second cocking pieces, which are both cocked by means included in the bolt collar. Once cocked, the cocking pieces can be released independently of each other for firing using trigger means. Pulling the bolt assembly rearwards ejects the fired cartridges through an ejection port on the receiver. The receiver also includes a cartridge injector port which couples to a magazine capable of storing additional cartridges. During the forward travel, the bolt assembly reloads the firing chambers with cartridges from the magazine.

7 Claims, 5 Drawing Sheets

DOUBLE BARREL BOLT ACTION REPEATING RIFLE

FIELD OF THE INVENTION

This invention relates generally to firearms and their firing mechanisms. More particularly, it relates to a bolt-action assembly for double-barrel rifles and shotguns.

BACKGROUND OF THE INVENTION

Firearms with a double-barrel design are most commonly found in shotgun design and high power rifle design. Typically, these designs do not allow for any magazine storage or reloading mechanism, other than the magazine storage inherent in the two rounds of ammunition stored in the firing chambers. To reload these firearms, the hunter must lower the rifle from the firing position and manually open the firing chambers to eject the spent shells and reload the chamber with fresh cartridges. Since there is no reloading mechanism, the hunter must insert the fresh rounds of ammunition by hand and close the breech before being ready to fire again. As can be appreciated, this reloading procedure is not only time consuming, but may be inconvenient when hunting dangerous big game, especially if the hunter has missed or wounded the animal with the first two shots.

Accordingly, there is a need for a reloading mechanism for double-barrel design firearms. In the field of high-powered big-game firearms, there is the additional requirement that the action must be robust and strong enough to withstand the extremely large forces generated when a high calibre cartridge is fired. It is for this reason that traditional big game rifles have been of the double-barrel design. As is well known in the art, a double-barrel design is one of the most reliable and robust actions. Although, there is really no action to speak of beyond the manual breech break for loading.

In the prior art there is one patent, of which I am aware, that discloses a bolt action mechanism for a double-barrel rifle or shotgun. U.S. Pat. No. 830,370, which issued to J. L. Saget on Sep. 4, 1906, teaches a firearm of the double-barrel breech-loading type. The firearm has a pair of cylindrical breech bolts (one for each barrel) which move rectilinearly forwards and backwards. A cross-bar connects the cylindrical breech bolts together at their rear ends. The cross-bar assembly also includes a swinging locking member, i.e. bolt. The locking member or bolt prevents the breech bolts from moving rearwards when in the locked position. When the shells are fired, the shootist swings the bolt to the open position and pulls it rearward. This action causes a pair of shell extractors in the breech bolts to eject the spent shells. The breech bolts can then be reloaded and the bolt moved forward and into the locking position. This invention falls short in two respects. First, while providing a breech-loading action for a double-barrel firearm, the invention does not provide magazine storage for additional rounds of ammunition. Secondly, the bolt mechanism as taught by Saget is inadequate to withstand the forces generated by today's high-powered rifles.

As indicated, various types of double-barrel breech-loading actions have been proposed, yet to my knowledge, there is no double-barrel firearm having a bolt action design capable of withstanding high-calibre ammunition or having a magazine storage which facilitates quick reloading or repeating firing. Thus, for whatever reason, be it structural complexity or failure to withstand the immense internal forces, no one has yet devised a double-barrel bolt action for high-calibre firearms.

Accordingly, it is an object of the present invention to provide a robust, reliable and durable bolt-action assembly for a double-barrel firearm, such as a high-calibre rifle or a shotgun, that also allows for magazine storage of additional rounds of ammunition thereby providing a repeater capability.

It is another object of the present invention to provide a bolt-action for a double-barrel firearm which can be easily disassembled for field cleaning.

It is yet another object of the present invention to provide a bolt-action for a double-barrel firearm in which the bolt-action utilizes a rear-bolt movement.

SUMMARY OF THE INVENTION

In one aspect, the present invention provides a double-barrel bolt action firearm, said firearm having two barrels and each barrel having a firing chamber for accepting a cartridge, said firearm comprising: (a) a magazine for storing additional cartridges; (b) a receiver, said receiver being coupled to the firing chamber of each barrel and to said magazine, said receiver including a first port for injecting the cartridges and a second port for ejecting the cartridges, and said receiver having a recess for accepting a bolt assembly; (c) said bolt assembly being slidably mounted in the recess of said receiver and being adapted for manual operation; and (d) said receiver being coupled to said magazine through said first port whereby, the cartridges in the firing chambers are ejected through said second port during the rearward manual operation of said bolt assembly, and two of the cartridges in said magazine are injected through said first port into the firing chambers during forward manual operation of said bolt assembly.

In another aspect, the present invention provides a bolt assembly for a double-barrel bolt action firearm, said firearm having two barrels each with a firing chamber for accepting a cartridge, and having a receiver, said receiver including a recess for accepting said bolt assembly, said bolt assembly comprising: (a) a bolt body having a bore; (b) first and second firing pin assemblies, said first and second firing pin assemblies being adapted to fit and slide in the bore of said bolt body; (c) manually operable bolt actuation means coupled to said bolt body, said bolt actuation means being adapted for manual operation of said bolt assembly and for manual cocking of said first and second firing pin assemblies; and (d) said bolt body including breech means for inserting and removing the cartridges from the firing chambers, and said breech means being adapted to accept said first and second firing pin assemblies.

In a third aspect, the present invention provides a bolt assembly of the rear-bolt type, for use in a double-barrel bolt action firearm including a receiver for slidably mounting said bolt assembly, said bolt assembly comprising: (a) a bolt body having a front portion and a rear portion; (b) breech bolt means coupled to the front portion of said bolt body; and (c) bolt actuation means rotatably mounted around and supporting the rear portion of said bolt body, said bolt actuation means including a bolt handle adapted for manual operation, and locking formations for engaging corresponding locking formations of the receiver by the manual operation of said bolt actuation means.

BRIEF DESCRIPTION OF THE DRAWINGS

For a better understanding of the present invention, and to show more clearly how it may be carried into effect, reference will now be made, by way of example, to the accompanying drawings in which.

DETAILED DESCRIPTION OF THE PREFERRED EMBODIMENT

Figure 1:
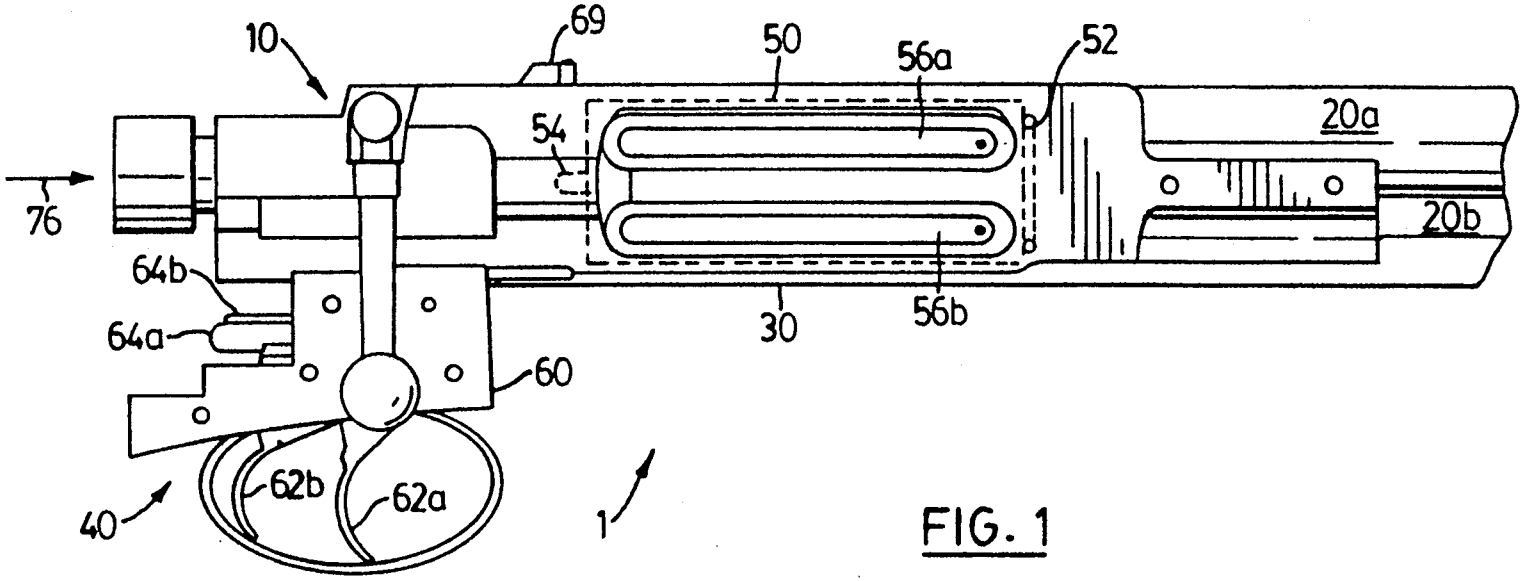
FIG. 1 is a side view of a partial firearm assembly incorporating a bolt-action assembly according to the present invention.

Referring to FIG. 1, a double-barrel firearm 1 incorporating a bolt-action assembly 10 according to the present invention is shown. The bolt assembly 10 is suitable for a double-barrel firearm such as a high-calibre rifle or a shotgun. The principal components of the double-barrel firearm 1 are first and second barrels 20*a*, 20*b*; a receiver 30; a trigger assembly 40; a box magazine 50 (shown using broken lines); and the bolt assembly 10.

Figure 8:
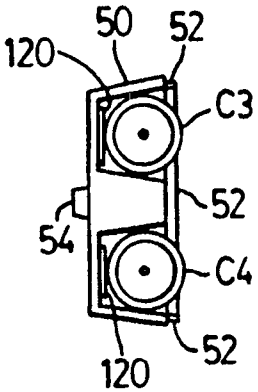
FIG. 8 is a sectional view of a box magazine according to the present invention.

The two barrels 20*a*, 20*b* are suitably attached, usually threaded (not shown), to one end of the receiver 30. The box magazine 50 attaches to the receiver 30 using a hinge connector 52 (shown in FIG. 8). The hinge connector 52 allows the box magazine 50 to be swung open, reloaded with fresh cartridges (indicated by c3 and c4 in FIG. 8) and swung back into the closed position. The box magazine 50 provides storage for extra cartridges and can be extended to hold more than two cartridges c3, c4. A latch 54 locks the magazine 50 in the closed position. As shown in FIG. 1, the receiver 30 includes first and second cartridge ejector ports 56*a*, 56*b*. On the other side of the receiver 30, there are first and second cartridge injector ports 58*a*, 58*b*, which are in line with the box magazine 50.

As shown in FIG. 1, a bracket 60 for mounting the trigger assembly 40 is attached to the receiver 30. The trigger assembly 40 is known in the art and comprises first and second triggers 62*a*, 62*b*; first and second trigger springs 63*a*, 63*b*; first and second pivoted sears 64*a*, 64*b*; and first and second sear springs 66*a*, 66*b*.

Referring now to FIGS. 2 to 8, the receiver 30 includes a recess 68 into which the bolt assembly 10 slidably fits. Using a release latch 69, the entire bolt assembly 10 can be easily removed for field cleaning. The bolt assembly 10 includes a bolt body 70 and a bolt collar 72 which fits over the bolt body 70 and using a bolt handle 74 attached to the bolt collar 72 the collar 72 is rotatable around the bolt body 70. The bolt collar 72 abuts and supports a flange 71 located on the bolt body 70. During discharge of the firearm 1, the bolt collar 72 in conjunction with the flange 71 prevents the bolt assembly 10 from being pushed backwards and possibly injuring the shootist. The bolt assembly 10 also includes a bolt sleeve 73 which fits over the end of the bolt body 70 and bolt collar 72.

Figure 3:
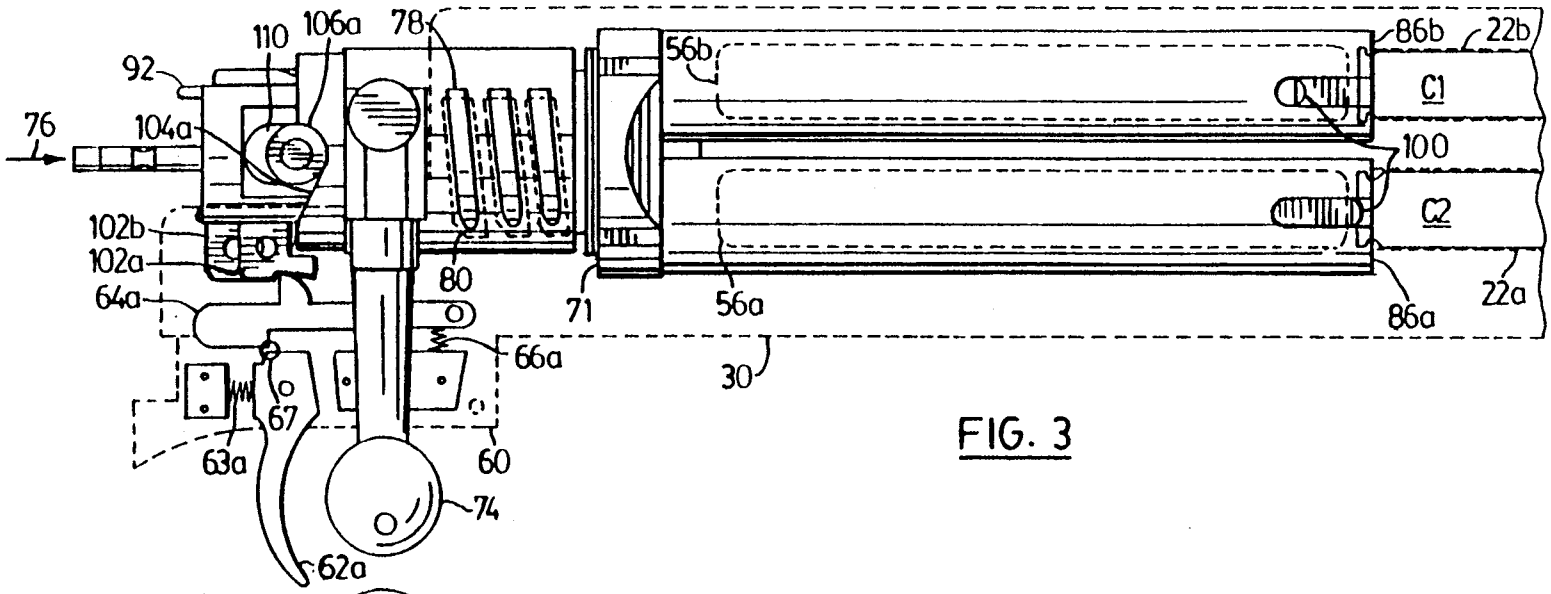
FIG. 3 is a side view of the bolt assembly in the cocked or firing position.
Figure 4:
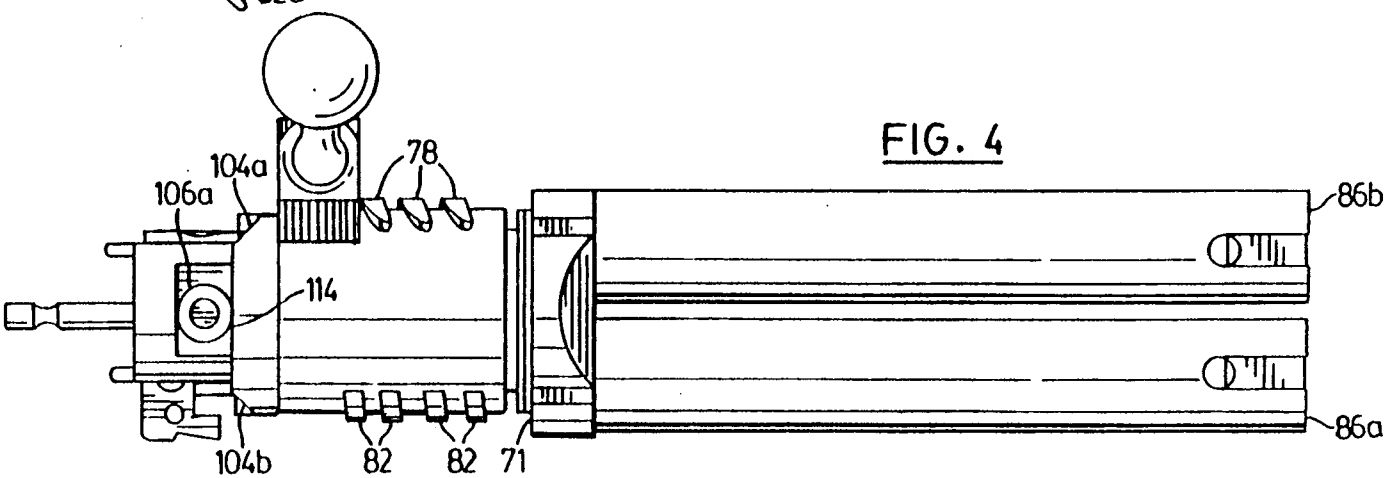
FIG. 4 is a side view of the bolt assembly in the unlocked or reloading position.
Figure 5:
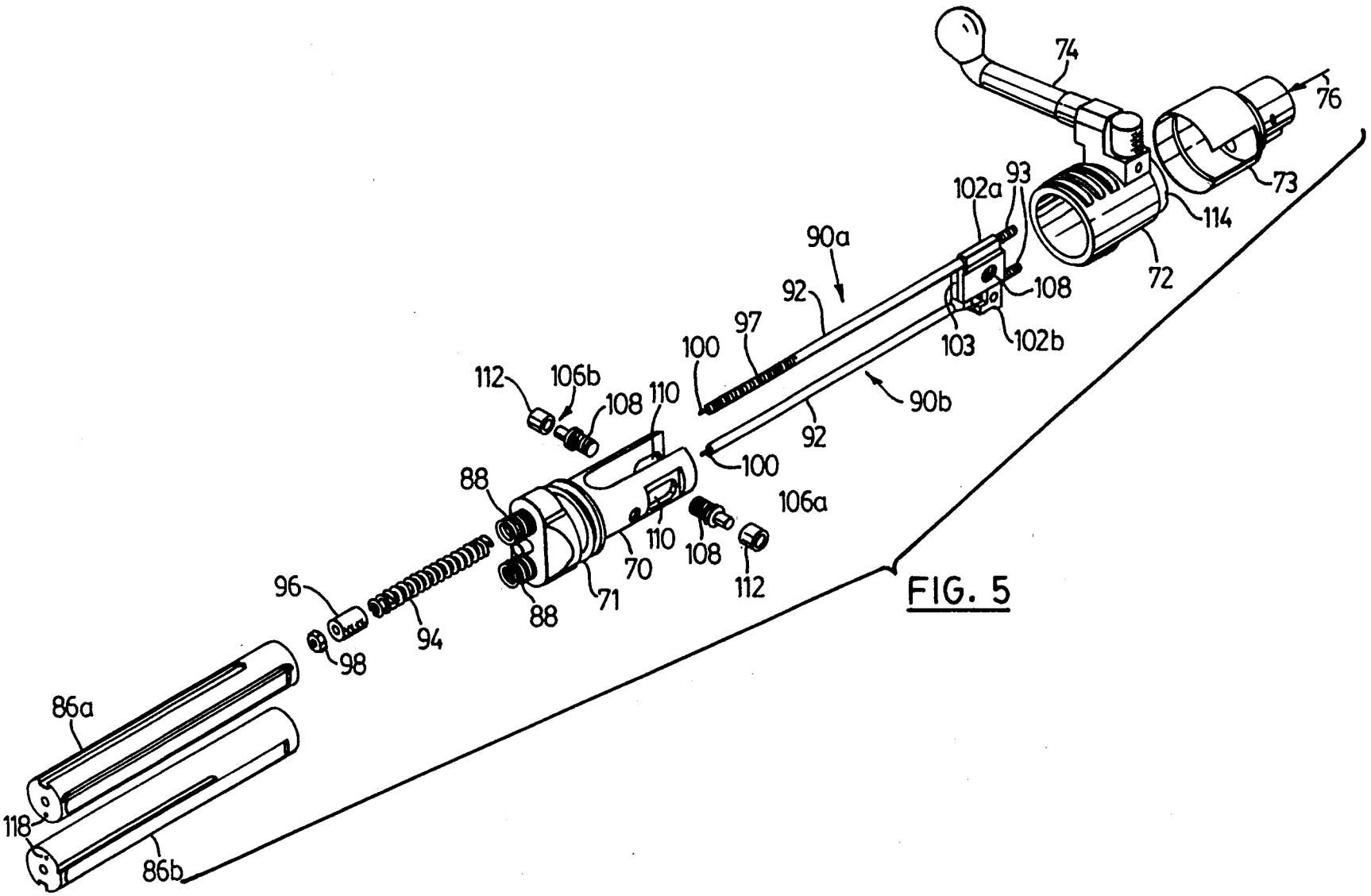
FIG. 5 is an exploded perspective view of the bolt assembly according to the present invention.
Figure 7:
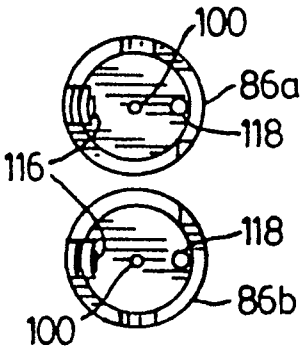
FIG. 7 is a front view of the breech bolts according to one aspect of the present invention.

In FIG. 3, the bolt assembly 10 is shown in the locked or firing position with the bolt handle 74 in the locked position. In FIG. 4, the bolt assembly 10 is shown in the unlocked or reloading position, which is attained by turning the handle 74 anticlockwise as viewed in the direction of the arrow 76.

The bolt collar 72 also includes two sets of rear locking formations, which are also known in the art as lugs. In the first set, there are three circumferentially spaced lugs 78. The lugs 78 are axially aligned so as to be slidable in corresponding axial locking grooves 80 in the recess of the receiver 30. In the second set, there are four circumferentially spaced lugs 82. The lugs 82 in the second set are also axially aligned to be slidable in corresponding axial locking grooves 84. The locking grooves 80, 84 are spaced to correspond to the position of the bolt assembly 10 in the locked position. The first and second set of lugs 78, 82 are also aligned with respect to each other to form an interrupted thread pattern.

To lock the bolt assembly 10, the bolt handle 74 is turned in the clockwise direction as viewed in the direction of the arrow 76, in response, the locking lugs 78, 82 enter the respective locking grooves 80, 84 and due to the thread pattern of the lugs 78, 82 and grooves 80, 84, there is a "screw" movement which positively locks the bolt assembly 10 in the closed or firing position. When the bolt assembly 10 is moved to the unlocked or reloading position, the locking lugs 78, 82 in conjunction with the grooves 80, 84 provide an opposite "screw" movement due to the thread pattern, as will be described in detail below.

It will be appreciated that the lugs 78, 82 in conjunction with the grooves 80, 84 provide a very important function. The lugs 78, 82 and grooves 80, 84 positively lock the bolt assembly 10 in the firing or closed position, and thereby prevent the bolt body 70 from being forced backwards when the cartridges c1, c2 are ignited. The strength of the lugs 78, 82 and grooves combination 80, 84 makes the bolt assembly 10 according to the present invention particularly suited for high calibre firearms.

Figure 9:
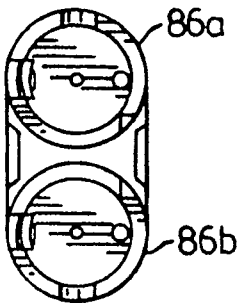
FIG. 9 is a front view of the breech bolt according to another aspect of the present invention.

As shown in FIGS. 3 and 4, the bolt assembly includes first and second breech bolts 86*a*, 86*b*. The breech bolts 86*a*, 86*b* securely fasten to threaded shafts 88 extending from one end of the bolt body 70. Both breech bolts 86*a*, 86*b* have a bore (not shown) which accepts respective firing pin assemblies 90*a*, 90*b*. In another embodiment of the present invention, the breech bolts 86*a*, 86*b* and bolt body 70 are machined as one unit, as shown in a front view in FIG. 9. As will be appreciated, one piece construction can result in weight savings, and a smaller bolt assembly 10 because the fastening means 88 for the breech bolts 86*a*, 86*b* are not required. However, one piece construction can also increase the manufacturing cost of the bolt assembly 10.

The firing pin assemblies 90*a*, 90*b* (FIG. 5) each comprise a firing pin rod 92, a firing pin spring 94, a spring tension adjuster 96, a spring tension lock 98, and a firing pin tit 100. The firing pin tit 100 can be formed from one end of the rod 92. The other end of the rod 92 connects to a cocking piece. For each firing pin assembly 90*a*, 90*b*, there are respective first and second cocking pieces 102*a*, 102*b*. In the preferred embodiment of the present invention, the rod 92 has a threaded end (not shown) which screws into the respective cocking piece 102*a*, 102*b*.

Figure 6:
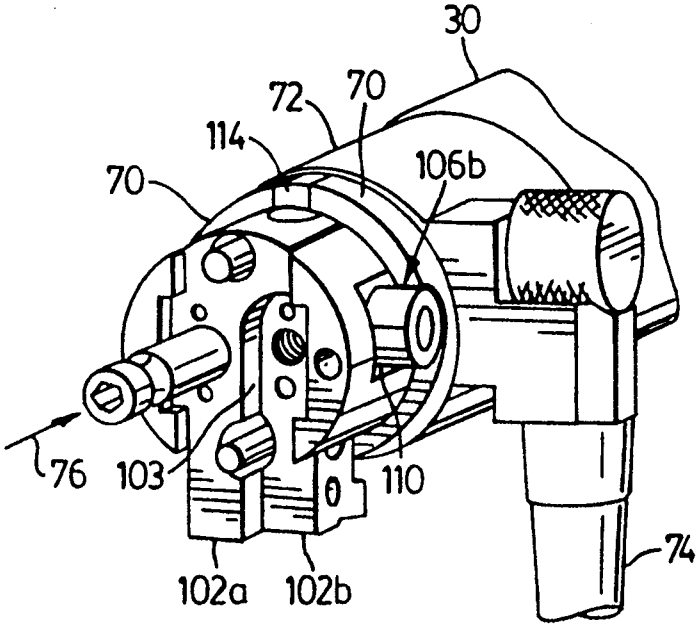
FIG. 6 is a perspective rear view of the bolt assembly with the bolt collar removed thereby exposing the ends portion of the bolt assembly and the ends of the first and second cocking pieces.

The cocking pieces 102*a*, 102*b* are designed with a complementary dovetail shape 103 (FIG. 6). The dovetail 103 allows the cocking pieces 102*a*, 102*b* to mesh with each for the cocking operation so that both pieces 102*a*, 102*b* are cocked together, but the pieces 102*a*, 102*b* can move independently of each other during the firing operation. In other words, the chambers 22*a* or 22*b* can be fired in any sequence by pulling the respective trigger 62*a* or 62*b*. However, during the cocking operation, both cocking pieces 102*a*, 102*b* are cocked at the same time by the action of the respective cam recesses 104*a*, 104*b* and the cams 106*a*, 106*b* which couple to the pieces 102*a*, 102*b*.

FIG. 3 shows the bolt assembly 10 in ready to fire position. In the firing position, the bolt assembly 10 is in its closed position engaged with the receiver 30 by the interlock of the locking lugs 78, 82 and the locking grooves 80, 84. The first and second firing pin rods 92 (FIG. 5), which are connected to the respective cocking pieces 102*a*, 102*b*, are held in the cocked position by the respective first and second pivoted sears 64*a*, 64*b*. On the pulling of one of the triggers 62*a*, 62*b*, the trigger 62*a*, 62*b* pivots, causing an upper catch to move forward, until the pivoted sear 64*a*, 64*b* falls at contact point 67. Once the pivoted sear 64*a*, 64*b* moves downward, the force of the firing pin spring 94, pushes or cams the associated pivoted sear 64*a*, 64*b* out of way against the force of the weaker sear spring 66*a*, 66*b*. The firing pin spring 94 then continues to project the associated firing pin shaft 92 and tit 100 into a forward firing position to ignite the cartridge c1 or c2 causing it to fire. The other firing pin is released in the same fashion when its associated trigger is pulled. The trigger 62*a*, 62*b* is held in position by the spring 63*a*, 63*b*.

Figure 2:
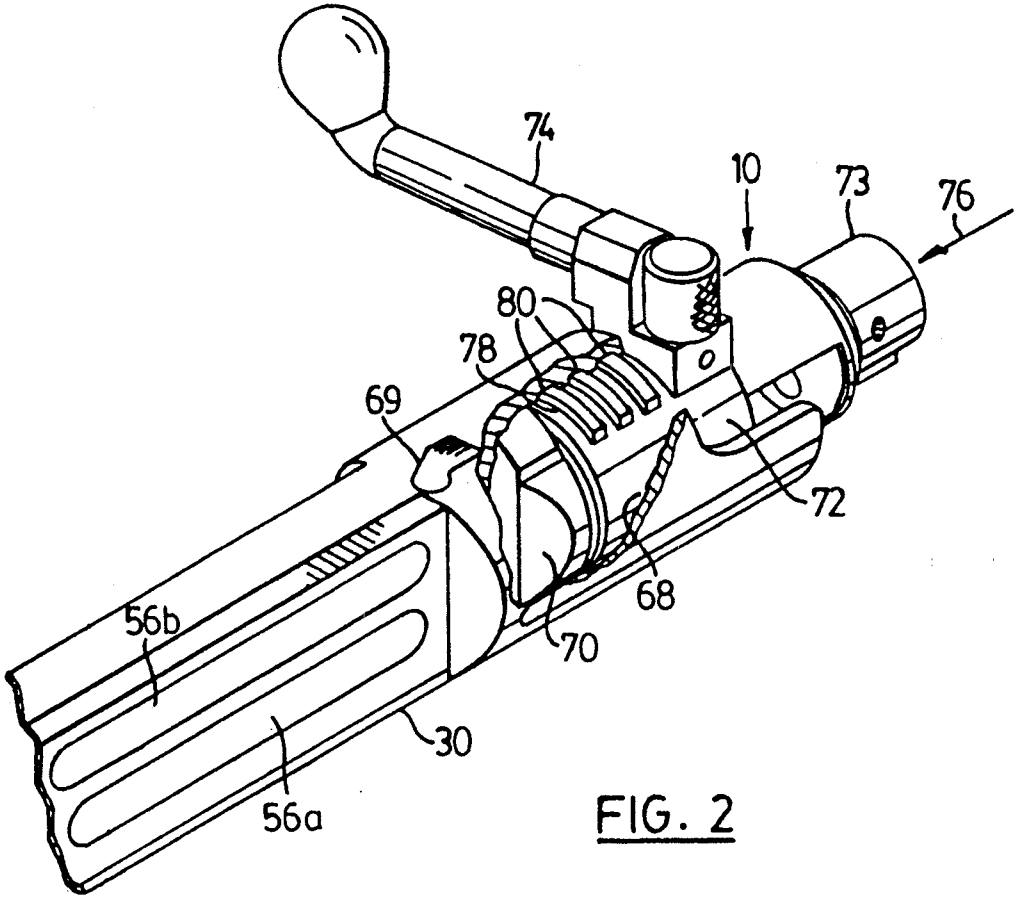
FIG. 2 is a perspective view of the bolt assembly shown partly cut away.

After both cartridges c1, c2 have been fired, the bolt assembly 10 is opened using the bolt handle 74 turned in an anticlockwise direction, as viewed in the direction of the arrow 76, into an unlocked but still closed position as shown in (FIGS. 2 and 4). The action of turning the bolt handle 74 from the locked to unlocked performs two key functions. The first function involves the cam action of the locking lugs 78, 82 as they are first moved out of the respective locking grooves 80, 84. The second function involves the cocking of the firing pin assemblies 90*a*, 90*b* when the bolt handle 74 and collar 72 are moved to the unlocked position.

Consider first the cam action of the locking lugs 78, 82. As shown in FIG. 3, the locking lugs are formed at an angle with respect to the vertical axis of the bolt collar 72, i.e. they form an interrupted thread pattern. When the bolt handle 74 is turned in the anticlockwise direction, as viewed in the direction of arrow 76, the lugs 78, 82 cause the bolt body 70 to move backwards or screw into the open position. This opening screw movement is useful in loosening any binding in the bolt assembly 10 which may occur due the cartridges c1, c2 expanding from the explosive ignition in the firing chambers 22*a*, 22*b*.

Referring still to FIG. 3, as the handle 74 and therefore the bolt collar 72 are turned in the anticlockwise direction, a cam action occurs between a cam recess on the bolt collar and a cam. There are first and second cam recesses 104*a*, 104*b*. The first cam recess 104*a* is associated with the cocking action of the first firing pin assembly 90*a*, and the other cam recess 104*b* is associated with the cocking action of the second firing pin assembly 90*b*.

There are also first and second cams 106*a*, 106*b* for the respective firing pin assemblies 90*a*, 90*b*. As shown in detail in FIG. 5, the cams 106*a*, 106*b* connect to the respective cocking pieces using threaded elements (indicated by 108). The cams 106*a*, 106*b* project through respective openings indicated by reference 110 in the bolt body 70. In the preferred embodiment, the cams 106*a*, 106*b* include respective roller bearings 112 (FIG. 5) to minimize wear on the cam recess 104*a*, 104*b*. When the bolt collar 72 is turned in the anticlockwise direction the cam action between the cams 106*a*, 106*b* and the cam recesses 104*a*, 104*b* causes the cocking of the firing pin assemblies 90*a*, 90*b* by moving the cocking pieces 102*a*, 102*b* in a rearward direction against the tension in the springs 94. To keep the firing pin assemblies 90*a*, 90*b* in the cocked position while the bolt assembly 10 is in the unlocked or reloading position, the bolt collar 74 includes two bolt locking catches indicated by 114. The two catches 114 mesh with the respective cams 106*a*, 106*b* causing the bolt collar 72 to remain in the reloading or unlocked position during the reloading action as will be discussed in detail below.

After the bolt collar 72 is turned to the unlocked or reloading position, the bolt assembly 10 is pulled rearwards using the handle 74. During the rearward excursion of the bolt assembly 10, an extractor 116 (FIG. 7) and an ejector 118 (FIG. 7) on each breech bolt 86*a*, 86*b* retract the fired cartridges c1, c2 from the two firing chambers 22*a*, 22*b* and expel them through the ejector ports 56*a*, 56*b*, in a manner known to one skilled in the art.

To reload the firing chambers 22*a*, 22*b* with fresh cartridges c3, c4 from the box magazine 50, the bolt assembly 10 is pushed forward and back into the receiver 30 using the bolt handle 74. On the forward excursion of the bolt assembly 10 to the closed position, the breech bolts pluck the cartridges c3, c4, which have been positioned in the injector ports by spring-loaded cartridge ramps 120 (FIG. 8) in the magazine 50, and push the cartridges c3, c4 into the respective firing chambers 22*a*, 22*b*.

After returning the bolt assembly 10 to the closed position (which corresponds to the unlocked position during the reloading operation), and thereby chambering the cartridges c3, c4, the first and second cocking pieces 106*a*, 106*b* are brought to bear against the pivoted sears 64*a*, 64*b*, which have been returned to their original position by springs 66*a*, 66*b*. The bolt assembly 10 is put into the locked and firing position by turning the bolt handle 74 in the clockwise direction, as viewed in the direction of the arrow 76. During the turning of the handle 74, the bolt collar 72 rotates and moves the locking lugs 78, 82 into interlock with the locking grooves 80, 84 thereby locking the bolt assembly 10 in the firing position. Also during the rotation of the bolt collar 72 into the firing position, the bolt locking catches 114 move out of operation in relation with the cams 106*a*, 106*b*. The bearing action of the pivoted sears 64*a*, 64*b* against the cocking pieces 102*a*, 102*b* relieves the force from the springs 94, which is being applied to the locking catches 114. This reduces the amount of force for turning the bolt assembly 10 into the firing position. The double barrel bolt assembly 10 according to the present invention is now ready for firing.

As will be appreciated, the bolt assembly 10 according to the present invention incorporates a rear-bolt mechanism. In a rear-bolt movement, the breech bolts 86*a*, 86*b* do not turn in the reloading and loading actions. Rather, the reloading and loading movements and locking of the firing pin assemblies 90*a*, 90*b* is accomplished by the bolt collar 72 turning on the bolt body 70 located at the rear of the bolt assembly 10. The bolt movement of the present invention eliminates the turning of breech bolts on the cartridge bases which in turn can lead to scoring of the cartridges, and jamming of the action, as has been known to occur in existing turn-bolt action designs.

In the preferred embodiment, the bolt assembly 10 is manufactured from high grade machine steel. The machined bolt assembly 10 is carbonized and surface hardened using known techniques. As will be appreciated by one skilled in the art, the surfacing hardening and carbonizing treatment provides a protective skin which reduces wear due to friction, but at the same time the tensile strength is retained by the untreated core of the bolt assembly 10.

It will be evident to those skilled in the art that other embodiments of the invention fall within its spirit and scope as defined by the following claims.

I claim:

1. A double-barrel firearm, said firearm having two barrels and each barrel having a firing chamber for accepting a cartridge, said firearm comprising:

(a) a magazine for storing additional cartridges;

(b) a receiver, said receiver being coupled to the firing chamber of each barrel of said two barrels and to said magazine, said receiver including a first port for injecting the cartridges and a second port for ejecting the cartridges, and said receiver having a recess for accepting a bolt assembly;

(c) said bold assembly being slidably mounted in the recess of said receiver;

(d) said receiver being coupled to said magazine through said first port;

(e) said bolt-assembly comprising a bolt body having a bore, first and second firing pin assemblies, said first and second firing pin assemblies being slidably mounted in the bore of said bolt body, bolt actuation means coupled to said bolt body for manually operating said bolt assembly, said bolt actuation means comprising a bolt collar rotatably mounted on said bolt body, and a bolt handle coupled to said bolt collar, said bolt collar including means for cocking said first and second firing pin assemblies, and said bolt body including breech bolt means for inserting and removing the cartridges from the firing chambers, said breech bolt means having means for accepting said first and second firing pin assemblies; and (f) the cartridges in the firing chambers being ejected through said second port during rearward manual operation of said bolt assembly, and two of the cartridges in said magazine being injected through said first port into the firing chambers during forward manual operation of said bolt assembly.

2. The bolt assembly as claimed in claim 1, wherein said means for cocking comprises first and second cam recesses and first and second cams, said first and second cam recesses being formed in said bolt collar and said first and second cams being coupled to said respective first and second firing pin assemblies, said cam recesses and said cams being engaged when said bolt collar is rotated using said bolt handle.

3. The bolt assembly as claimed in claim 1 or 2, wherein said first and second firing pin assemblies include respective first and second cocking pieces, said cocking pieces being responsive to said bolt collar and having means for cocking said firing pin assemblies, and said cocking pieces having means for independently releasing each of said firing pin assemblies.

4. The bolt assembly as claimed in claim 1 or 2, wherein said bolt collar includes locking formations for engaging corresponding locking formations of the receiver, and said bolt body includes a flange that is supported by said bolt collar, and wherein said bolt collar is rotatable between a disengaged position and an engaged position in which the locking formations of said bolt collar engage the receiver, and during the rotation to said disengage position said bolt actuation means operate to cock to said first and second firing pin assemblies.

5. A bolt assembly for a double-barrel bolt action firearm, the firearm having two barrels each with a firing chamber for accepting a cartridge, and having a receiver, said receiver including a recess for accepting said bolt assembly, said bolt assembly comprising:

(a) a bolt body having a bore;

(b) first and second firing pin assemblies, said first and second pin assemblies being slidably mounted in the bore of said bolt body;

(c) bolt actuation means for operating said bolt assembly and for cocking said first and second firing pin assemblies, said bolt actuation means being coupled to said bolt body, said bolt actuation means comprising a bolt collar, a bolt handle coupled to said bolt collar, said bolt collar including means for cocking said first and second firing pin assemblies;

(d) said bolt body including breech bolt means for inserting and removing the cartridges from the firing chambers, and said breech bolt means having means for receiving said first and second firing pin assemblies;

(e) said means for cocking comprising first and second cam recesses and first and second cams, said cam recesses and said cams being engaged when said bolt collar is rotated by said bolt handle.

6. The bolt assembly as claimed in claim 5, wherein said first and second firing pin assemblies include respective first and second cocking pieces, said cocking pieces being responsive to said bolt collar and having means for cocking said firing pin assemblies, and said cocking pieces including means for independently releasing each of said firing pin assemblies.

7. The bolt assembly as claimed in claim 6, wherein each of said first and second firing pin assemblies comprises a firing pin rod, said firing pin rod including first and second threaded portions, said first threaded portion being coupled to one of said respective first and second cocking pieces, a firing pin spring which fits over said firing pin rod, a spring tension adjuster coupled to said second threaded portion for adjusting the tension of said firing spring, a spring tension lock also coupled to said second threaded portion, and a firing pin tit formed from one end of said firing pin rod.

* * * * *